US006352518B1

(12) United States Patent
nee Wolf

(10) Patent No.: US 6,352,518 B1
(45) Date of Patent: Mar. 5, 2002

(54) APPLIANCE FOR VIBRATION THERAPY WITH MOTOR HOUSING AND ECCENTRIC HEAD DRIVE

(76) Inventor: Helga Ruf nee Wolf, Pfützenstrasse 58, 64347 Griesheim (DE)

( * ) Notice: Subject to any disclaimer, the term of this patent is extended or adjusted under 35 U.S.C. 154(b) by 0 days.

(21) Appl. No.: 09/440,789

(22) Filed: Nov. 15, 1999

(51) Int. Cl.[7] ..... A61H 7/00
(52) U.S. Cl. ..... 601/89; 601/84; 601/67
(58) Field of Search ..... 601/70, 72, 80, 601/84, 85, 87, 89, 93, 94, 97, 101–103, 107–111, 82, 67; 15/22.1, 23

(56) References Cited

U.S. PATENT DOCUMENTS

| | | | | | |
|---|---|---|---|---|---|
| 782,663 | A | * | 2/1905 | Johansen | 601/85 |
| 912,016 | A | * | 2/1909 | Miller | 601/85 |
| 4,102,334 | A | * | 7/1978 | Muchisky | 128/36 |

FOREIGN PATENT DOCUMENTS

| | | | | |
|---|---|---|---|---|
| DE | 3400 587 C1 | | 8/1984 | |
| DE | 89 08 366 U1 | | 11/1989 | |
| DE | 196 34 650 | | 3/1998 | |
| DE | 196 34 650 A1 | | 3/1998 | |
| EP | 05 28 746 A1 | | 2/1993 | |
| FR | 402762 | * | 10/1909 | 601/85 |
| GB | 351270 | * | 6/1931 | 601/85 |
| WO | WO97 10 794 A1 | | 3/1997 | |

* cited by examiner

*Primary Examiner*—Justine R. Yu
(74) *Attorney, Agent, or Firm*—Herbert Dubno

(57) ABSTRACT

A device for vibration and percussive therapy uses an oscillation generator which is affixed to a stub of the motor shaft projecting beyond a bearing in which the motor shaft is journaled. The oscillation generator has a pin which is inclined at an angle to the axis of its shoulder which bears against a shoulder between the shaft and a stub thereof and which is secured to the stub by a setscrew.

16 Claims, 3 Drawing Sheets

APPLIANCE FOR VIBRATION THERAPY WITH MOTOR HOUSING AND ECCENTRIC HEAD DRIVE

FIELD OF THE INVENTION

My present invention relates to an appliance or device for carrying out vibration and percussive therapy for the treatment of pathology relating to the bone, musculature and lungs of an individual or for prophylaxis against a disorder or simply as a device for promoting the wellbeing of a human organism.

BACKGROUND OF THE INVENTION

In German Patent DE-OS 196 34 650 there is described an appliance for vibration therapy in which an oscillation generator is driven by a drive shaft connected to or forming part of an electric motor and has an oscillating head. The head is connected to the oscillation generator at an angle to the axis of the drive shaft so that a wobbling motion is imparted to the head.

In practice it has been found that this system is too heavy for incorporation in a hand-held massager device so that the range of usage of the prior system has been limited. Fabrication is also complicated and hence the manufacturing cost is high. The construction in this document is, moreover, prone to rapid wear. Other drawbacks of prior art systems of this type include the nondismountability and the nonreplaceability of the oscillating head so that it is not possible to change the head for various applications for which the device may be desirable. Accordingly, the versatility of the device is very limited.

OBJECTS OF THE INVENTION

It is, therefore, the principal object of the present invention to provide a compact light weight device for the purposes described which has a range of uses far greater than those of the prior art systems and which can be fabricated at a reduced cost.

Another object of the invention is to provide a hand-held massage device capable of performing vibration and percussive therapy and which enables the oscillating head to be replaced by others, depending upon the particular purpose and use of the device.

Still another object of this invention is to provide a device for vibration and percussive therapy which is free from drawbacks of the prior art.

SUMMARY OF THE INVENTION

These objects and others which will become apparent hereinafter are attained in accordance with the invention with a device for vibration and percussive therapy which comprises:

a housing;

a motor on the housing;

a bearing on the housing;

a shaft journaled in the bearing and driven by the motor, the shaft having a stub extending beyond the bearing;

an oscillation generator having a body formed with an axial bore receiving the stub of the shaft and an eccentric portion inclined to an axis of the shaft and the bore; and an oscillating head receiving the eccentric portion and oscillated thereby upon rotation of the shaft by the motor.

The oscillation generator according to the invention has a shoulder which rests against an annular surface or shoulder between the drive shaft and the stub on which the oscillation generator is mounted and which projects beyond a ball bearing in which the shaft is journaled on the housing. The portion of the oscillation generator on which the head is replaceably mounted is preferably a pin whose axis is inclined to the axis of the shaft and the aforementioned shoulder.

A rotation of the shaft swings the pin and imparts a wobbling motion to the oscillation head which, according to the invention, is rotatable on this pin in ball bearings so that the center of motion of the head remains more or less constant while the remaining functional surfaces of the head wobble and have a three-dimensional movement.

The oscillation generator is not itself journaled in the housing and is so carried by the drive shaft that the latter is the part which is journaled in the housing and is supported by the housing bearing.

The configuration of the oscillation generator in combination with the mounting of only the drive shaft in bearings enables a substantial reduction in the dimensions and weight of the device, by comparison with earlier systems, and allows the device to be substantially more compact. Since the oscillation generator is mounted on the stub of the shaft beyond the bearing supporting same, a replacement of the oscillation generator and of the head carried thereby is greatly facilitated.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
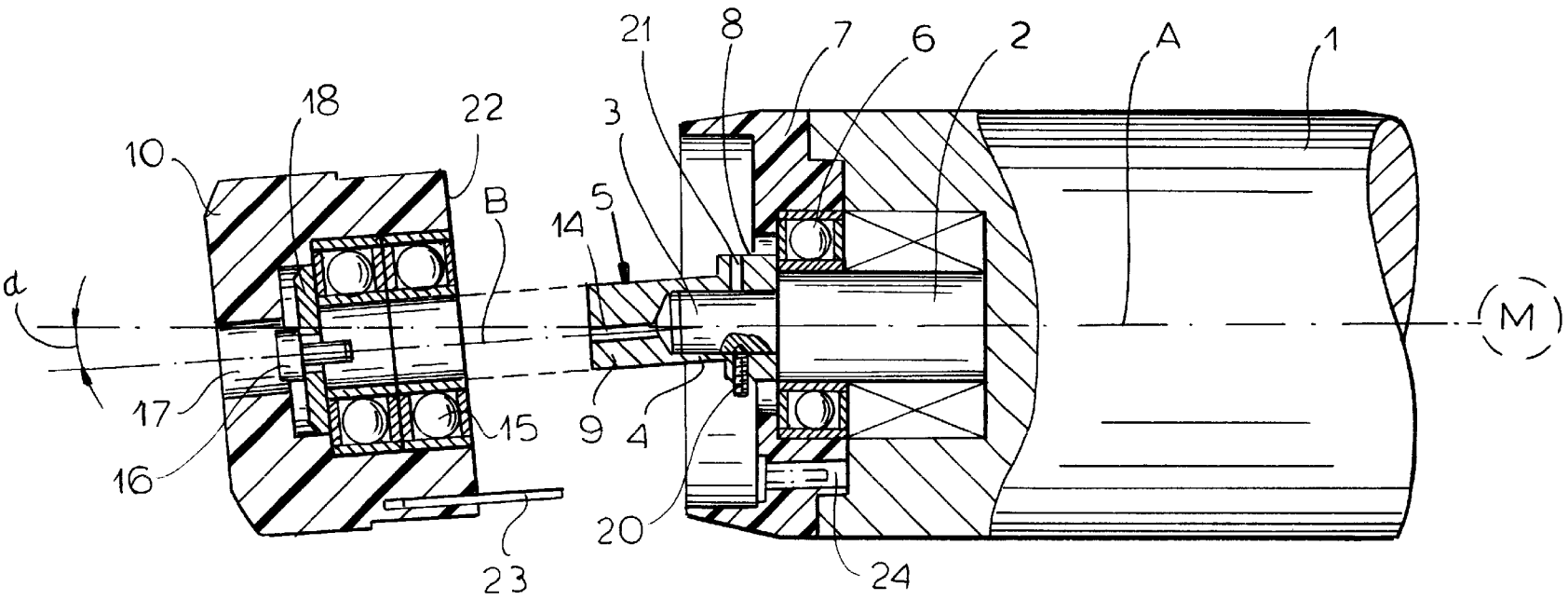
FIG. 1 is an exploded view, partly in section, of the barrel portion of a device for vibration and percussive massager according to the invention, the housing of which is generally pistol-shaped.
Figure 2:
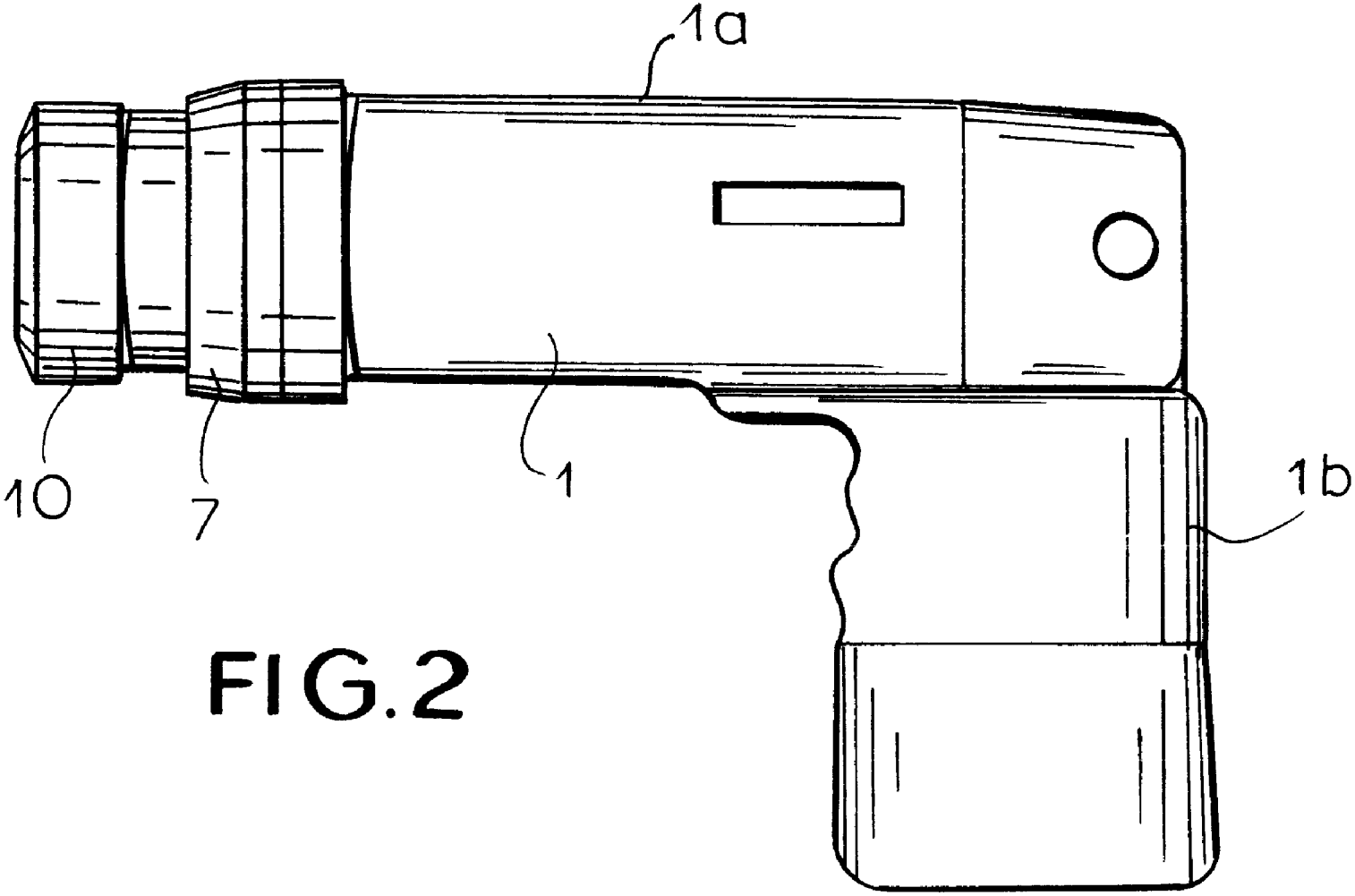
FIG. 2 is a side elevational view thereof.
Figure 5:
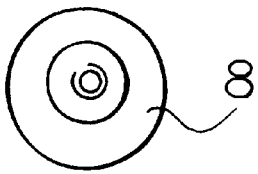
FIG. 5 is an opposite end view of the oscillation generator.
Figure 7:
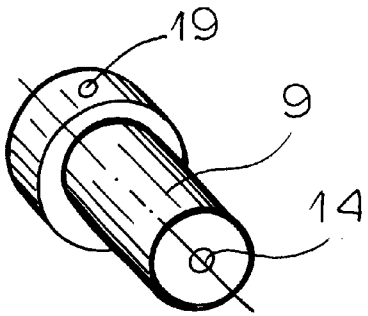
FIG. 7 is a perspective view of the oscillation generator form the other side.
Figure 4:
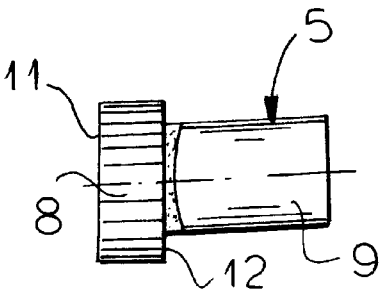
FIG. 4 is a side elevational view of the oscillation generator.
Figure 3:
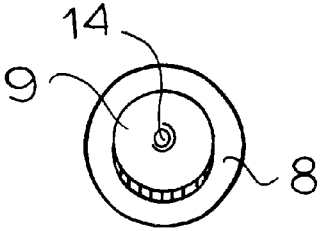
FIG. 3 is an end view of the oscillation generator.
Figure 6:
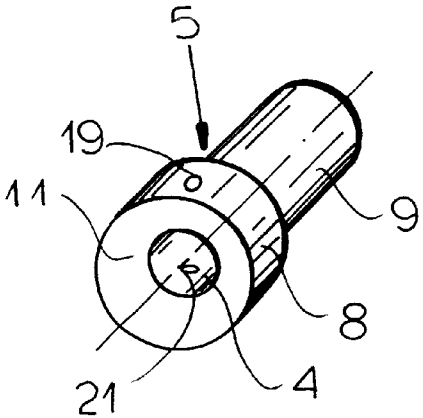
FIG. 6 is a perspective view of the oscillation generator from one side.

The housing 1 (FIGS. 1 and 2) of the vibration and percussive massager of the invention has a pistol shape with a barrel 1*a* and a handle 1*b*. The latter may contain a battery for the motor M within the housing barrel 1*a*. The drive shaft 2 of the electric motor is journaled in bearings, preferably ballbearings, one of which has been shown at 6, the shaft 2 being formed with a stub 3 beyond the bearing 6. The bearing 6 is held in a cage which may be formed from a resilient material such as rubber and can close the end of the housing as shown at 7 in FIG. 1. An oscillation generator 5 has an axial bore 4 receiving the stub 3 and is therefore fitted on an end of the shaft projecting out of the housing as seen in FIG. 1. The oscillation generator 5 itself has no bearing in the housing and is entirely accessible outside the housing.

As can be seen from FIGS. 3–7, the oscillation generator is formed in one piece with a body 8 of the oscillation generator and an eccentric portion in the form of a pin 9, the latter beingreceivable in the ball bearings 15 of an oscillating head 10. The surface 11 (FIG. 4) of the body 8 turned away from the pin lies in plane perpendicular to the axis of the bore 4 and hence perpendicular to the axis A of shaft 2. The pin 9 is perpendicular to a surface 12 on the opposite side of the shoulder. The surface 12 lies in a plane which is inclined to the plane of the surface 11. The axis B of the pin 9 is therefore inclined to the axis A of the motor shaft 2 at an angle a so that upon rotation of the latter, a wobble is produced.

The pin 9 has a threaded bore 14 extending axially in the pin 9 and opening at the free end thereof. As shown in the drawing, the bore 14 can extend through the oscillation generator 5 to open into the bore 4 but that is not necessary. The bore 14 is adapted to threadedly receive a screw 16 which is accessible through a recess 17 in the oscillation head 10 and by which the head can be removably attached to the pin 9 (FIG. 1). The bore 14 and the screw 16, therefore, serve to enable the head to be connected to the oscillation generator in an axially fixed manner but enabling rotation of the head 10 on the bearing 15 relative to the pin 9. They also permit removal of the head 10 and replacement by a head of a different shape as may be desirable for the particular massage use to which the head is to be put. The screw 16 bears upon a washer 18 received in the head 10 and engaging the inner recess of the bearing 15.

The oscillation generator 5 itself is mounted on the stub 3 via a setscrew 20 threaded into a radial bore 19 and engaging in recess in the stub 3 to prevent separation of the oscillation generator 5 from the stub 3 without loosening of the screw 20. The diameter of the body 8 is sufficient to accommodate the setscrew and the radially threaded bore 19 and to provide a secure attachment of the oscillation generator to the shaft. A further radial bore 21 in the body 8 serves to enable the oscillation generator to be held during the assembly of the apparatus. The setscrew 20 is accessible following removal of the head 10.

Extending inwardly from the inner surface 22 of the head 10 is a pin 23 which engages in the bore 24 which is lined with or formed in an elastic material. In the embodiment shown the bore 24 is formed directly in the cage 7 which is composed of elastomeric material. The pin 23 prevents free rotation of the head 10 but enables the pin 9 to rotate therein, thereby permitting the wobble movement of the head 10 without rotation. For this reason the hole 24 should have a diameter greater than that of the pin 23. The configuration of the oscillation generator 5 and the manner by which it is connected to the shaft enables a compact construction of the device which can have only 1/5 the weight of the earlier appliance described and is of a substantially reduced cost.

As has been noted, the housing can have the configuration of a pistol and thus can be easily handled. Because of the compact configuration and reduced dimensions, in addition to the reduced weight, it can be used with considerable effect for treatment of the spinal column and for localized treatments anywhere on the body, e.,g. for acupressure and nerve and muscle stimulation in a transcutaneous manner. It is also suitable for treatment of the meridians, the trigger points and for mucoviscidosis disorders of infants and other subjects. The device of the invention can be used for therapy against pain and, of course, for the treatment of animals as well as human patients.

I claim:

1. A device for vibration and percussive therapy comprising:

a housing;

a motor in said housing;

a bearing in said housing;

a shaft journaled in said bearing and driven by said motor, said shaft having a stub extending beyond said bearing;

an oscillation generator having a body formed with an axial bore receiving said stub of said shaft and an eccentric portion inclined to an axis of said shaft and said bore; and an oscillating head receiving said eccentric portion and oscillated thereby upon rotation of said shaft by said motor.

2. The device defined in claim 1 wherein said body forms a first shoulder having an annular surface lying in a plane perpendicular to said axis and abutting a shoulder between said shaft and said stub, and a second shoulder inclined to said first shoulder, said eccentric portion being a pin perpendicular to said second shoulder.

3. The device defined in claim 2 wherein said oscillation generator has another bore inclined to the first-mentioned bore.

4. The device defined in claim 2 wherein said head is journaled on said eccentric portion via ball bearings.

5. The device defined in claim 4 wherein said eccentric portion is provided with a threaded bore along an axis of said eccentric portion, said head being mounted on said eccentric portion by a screw threaded into said threaded bore.

6. The device defined in claim 5 wherein said body is provided with a radial threaded bore, a setscrew being received in said radial threaded bore to clamp said oscillation generator on said stub.

7. The device defined in claim 6 wherein said head is provided with an axially extending pin having a free end engaging in a hole formed in a bearing cage composed of elastic material in said housing, said hole being of a diameter greater than that of said axially extending pin.

8. The device defined in claim 7 wherein said elastic material receives an outer race of the bearing in said housing.

9. The device defined in claim 8 wherein said bearing in said housing is a ball bearing.

10. The device defined in claim 9 wherein said housing has a handle and has a pistol shape.

11. The device defined in claim 1 wherein said head is journaled on said eccentric portion via ball bearings.

12. The device defined in claim 1 wherein said eccentric portion is provided with a threaded bore along an axis of said eccentric portion, said head being mounted on said eccentric portion by a screw threaded into said threaded bore.

13. The device defined in claim 1 wherein said body is provided with a radial threaded bore, a setscrew being received in said radial threaded bore to clamp said oscillation generator on said stub.

14. The device defined in claim 1 wherein said head is provided with an axially extending pin having a free end engaging in a hole formed in a bearing cage composed of an elastic material in said housing, said hole being of a diameter greater than that of said axially extending pin.

15. The device defined in claim 14 wherein said elastic material receives an outer race of the bearing in said housing.

16. The device defined in claim 1 wherein said bearing in said housing is a ball bearing.

* * * * *